US011413490B1

(12) United States Patent
Xu

(10) Patent No.: US 11,413,490 B1
(45) Date of Patent: Aug. 16, 2022

(54) INTELLIGENT ELECTRICALLY ADJUSTABLE DUMBBELL

(71) Applicant: Shenzhen Jingdu Technology Co., Ltd., Shenzhen (CN)

(72) Inventor: Shaoyuan Xu, Shenzhen (CN)

( * ) Notice: Subject to any disclaimer, the term of this patent is extended or adjusted under 35 U.S.C. 154(b) by 0 days.

(21) Appl. No.: 17/501,006

(22) Filed: Oct. 14, 2021

(30) Foreign Application Priority Data

Sep. 6, 2021 (CN) ..... 202111037804.5

(51) Int. Cl.
*A63B 21/075* (2006.01)
*A63B 24/00* (2006.01)
*A63B 21/072* (2006.01)

(52) U.S. Cl.
CPC ..... *A63B 21/075* (2013.01); *A63B 21/0726* (2013.01); *A63B 21/0728* (2013.01); *A63B 24/0087* (2013.01)

(58) Field of Classification Search
CPC ..... A63B 21/072; A63B 21/0726; A63B 21/0728; A63B 21/075; A63B 24/0087
See application file for complete search history.

(56) References Cited

U.S. PATENT DOCUMENTS 7,578,771 B1 * 8/2009 Towley, III ..... A63B 71/0619 482/106
8,784,283 B2 * 7/2014 Svenberg ..... A63B 21/00069 482/108
8,932,188 B2 * 1/2015 Svenberg ..... A63B 21/072 482/107
9,643,042 B2 * 5/2017 Madden ..... A63B 23/12
9,895,571 B2 * 2/2018 Wang ..... A63B 21/075
10,166,427 B2 * 1/2019 Myre ..... A63B 21/00065
10,463,906 B2 * 11/2019 Owusu ..... A63B 21/0726
10,518,123 B2 * 12/2019 Moran ..... A63B 21/075
10,843,028 B2 * 11/2020 Nalley ..... A63B 21/0604
10,974,093 B2 * 4/2021 Wang ..... A63B 21/0726
11,219,795 B1 * 1/2022 Yao ..... A63B 71/0619
2006/0025287 A1 * 2/2006 Chermack ..... A63B 21/075 482/107
2009/0197745 A1 * 8/2009 Olson ..... A63B 21/0728 482/107
2013/0324375 A1 * 12/2013 Svenberg ..... A63B 21/0728 482/108
2016/0089575 A1 * 3/2016 Smith ..... A63B 21/0726 482/5
2020/0376320 A1 * 12/2020 Wang ..... A63B 21/075
2021/0154519 A1 * 5/2021 Chen ..... A63B 21/0728

* cited by examiner

*Primary Examiner* — Joshua Lee

(57) ABSTRACT

An intelligent electrically adjustable dumbbell includes a dumbbell body. The dumbbell body includes a handle; a first and a second weight, assembly. The handle includes a handle body, a driving device, a first telescopic rod and a second telescopic rod. The first and the second telescopic rods are connected to the first and the second weight assemblies respectively. Each of the first and the second weight assemblies includes a plurality of dumbbell pieces. Each dumbbell piece defines a shaft hole. A fastening assembly is connected between two adjacent dumbbell pieces and configured to prevent the two adjacent dumbbell pieces from relative axial movement. The driving device is configured to drive the first and the second telescopic rods to extend into one or more shaft holes so as to mount one or more dumbbell pieces onto two opposite ends of the handle body to adjust weight of the dumbbell body.

15 Claims, 12 Drawing Sheets

INTELLIGENT ELECTRICALLY ADJUSTABLE DUMBBELL

CROSS-REFERENCE TO RELATED APPLICATIONS

The application claims priority of Chinese patent application No.: 202111037804.5, filed on Sep. 6, 2021, which is incorporated herein by reference in its entireties.

FIELD

The subject matter herein generally relates to dumbbells, and particularly relates to an intelligent electrically adjustable dumbbell.

BACKGROUND

With continuous improvement of people's living standards, people's pursuit at material things is getting higher and higher, especially in the demand for fitness equipment. Dumbbells, as fitness, equipment for exercise, have attracted much attention from consumers. However, existing dumbbells on the market not only need users to manually adjust the weight of dumbbells, but also cannot quickly know current weight of dumbbells. It needs repeated calculation to obtain the current weight of dumbbells, which makes it difficult for users to adjust dumbbells to their own weight. It is time consuming and laborious, single functional, which makes users often feel boring when using. Therefore, there is a desire to provide a dumbbell which is convenient for users to adjust weight and has multiple functions in order to improve user experience.

SUMMARY

In order to solve above-mentioned technology problems, the present disclosure provides an intelligent electrically adjustable dumbbell, which is convenient for users to adjust weights and has multiple functions.

An intelligent electrically adjustable dumbbell includes a dumbbell body. The dumbbell body includes a handle; a first weight assembly connected with one end of the handle, and a second weight assembly connected with the other end of the handle. The handle includes a handle body, a driving device arranged at the handle body, a first telescopic rod and a second telescopic rod movably connected with two opposite ends of the handle body. The first telescopic rod is connected to the first weight assembly, and the second telescopic rod is connected to the second weight assembly. Each of the first weight assembly and the second weight assembly includes a plurality of dumbbell pieces. Each of the plurality of dumbbell pieces defines a shaft hole. A fastening assembly is connected between two adjacent dumbbell pieces and configured to prevent the two adjacent dumbbell pieces from relative axial movement. The driving device is configured to drive the first telescopic rod and the second telescopic rod to extend into one or more shaft holes so as to mount one or more dumbbell pieces onto two opposite ends of the handle body to adjust weight of the dumbbell body.

In at least one embodiment, the dumbbell body is provided with a switch electrically connected with the driving device, the switch is configured to switch on/off the driving device, when the switch is activated, the driving device is switched to a working state; when the switch is not activated, the driving device is switched to a stop state.

In at least one embodiment, the intelligent electrically adjustable dumbbell further incudes a tray configured to carry the dumbbell body thereon. The tray is provided with a trigger member, when the dumbbell body is positioned on the tray, the trigger member activates the switch; when the dumbbell body is separated from the tray, the trigger member releases trigger of the switch.

In at least one embodiment, the trigger member is a bump, the switch is provided with an elastic piece, when the bump compresses the elastic piece, the switch is activated, and when the bump releases the elastic piece, the elastic piece restores and the trigger member releases trigger of the switch.

In at least one embodiment, the driving device includes a motor, a first sprocket, a second sprocket and a chain. An output axis of the motor is connected to the first sprocket, the first sprocket and the second sprocket are meshed with the chain. The output axis is configured to drive the first sprocket, the second sprocket and the chain to rotate. A lower side of the chain is connected to the first telescopic rod, and an upper side of the chain is connected to the second telescopic rod, so that rotation of the chain is capable of bringing the first telescopic rod and the second telescopic rod to extend into one or more shaft holes of one or more dumbbell pieces.

In at least one embodiment, the driving device includes a motor, a first synchronous wheel, a second synchronous wheel and a synchronous belt. An output axis of the motor is connected to the first synchronous wheel, the first synchronous wheel and the second synchronous wheel are connected with the synchronous belt. The output axis is configured to drive the first synchronous wheel, the second synchronous wheel and the synchronous belt to rotate. A lower side of the synchronous belt is connected to the first telescopic rod, and an upper side of the synchronous belt is connected to the second telescopic rod so that rotation of the synchronous belt is capable of bringing the first telescopic rod and the second telescopic rod to extend into one or more shaft holes of one or more dumbbell pieces.

In at least one embodiment, the dumbbell body is further provided with a control mainboard and a display device, the motor is provided with an encoder, the encoder is configured to detect a rotation direction and a rotation angle so as to determine the number of the dumbbell pieces whose shaft holes are passed through by the first telescopic rod and the second telescopic rod, the control mainboard and the display device are electrically connected to the encoder, the control mainboard is configured to determine the weight of the dumbbell body according to the number of the dumbbell pieces whose shaft holes are passed through by the first telescopic rod and the second telescopic rod and to transmit the weight of the dumbbell body to the display device, the display device is configured to display the weight of the dumbbell body.

In at least one embodiment, the control mainboard is further provided with a gyro and an accelerometer, the gyro and the accelerometer are electrically connected to the display device and configured to detect movement times and frequencies of the dumbbell body and transmit the movement times and frequencies of the dumbbell body to the display device so that the display device is capable of displaying the movement times and frequencies of the dumbbell body.

In at least one embodiment the control mainboard is further provided with a photoelectric sensing device electrically connected with the display device, the photoelectric sensing device is configured to detect user's heart rate and transmit the heart rate to the display device so that the display device is capable of displaying the user's heart rate.

In at least one embodiment, the dumbbell body is further provided with a microphone and a voice recognition module electrically connected with the control mainboard, the microphone is configured to detect user's voice and the voice recognition module is configured to convert the user's voice to commands to adjust the weight of the dumbbell body.

In at least one embodiment, the dumbbell body is further provided with a Bluetooth module electrically connected to the control mainboard and configured to be connected to a mobile terminal device so as to receive commands from the mobile terminal device to adjust the weight of the dumbbell body.

In at least one embodiment, the dumbbell body is further provided with a speaker electrically connected with the control mainboard and configured to output the weight of the dumbbell body.

In at least one embodiment, the dumbbell is further provided with a battery and a power input port configured to supply power to the driving device, the control mainboard and the display device.

In at least one embodiment, the dumbbell body is further provided with an LED lamp and a buzzer, the LEI) lamp and buzzer are electrically connected with the control mainboard and configured to reminder users of the dumbbell under different working states.

In at least one embodiment, the dumbbell body is further provided with an adjustment key configured to control the driving device to drive the first telescopic rod and the second telescopic rod into one or more shaft holes of one or more dumbbell pieces.

In at least one embodiment, wherein the adjustment key includes a first adjusting key unit and a second adjusting key unit, the first adjusting key unit is configured to control the first telescopic rod and the second telescopic rod to enter more shaft holes of the dumbbell pieces so as to increase the weight of the dumbbell main body, and, the second adjusting key unit is configured to control the first telescopic rod and the second telescopic rod to retract so as to reduce the weight of the dumbbell body.

In at least one embodiment, the handle is provided with anti-skid lines configured to prevent user's hand from falling off the handle.

In at least one embodiment, a cross section of the fastening assembly is in a T shape.

Through the intelligent electrically adjustable dumbbell, it effectively realizes a function of automatically adjusting weight of the dumbbell body 1 through the driving device 6, the first telescopic rod 42 and the second telescopic rod 43. Therefore, it does not need users to mount manually the dumbbell pieces to adjust the weight of the dumbbell body, which can save time and manpower, thereby greatly improving user experience. Moreover, since the fastening assembly 71 can prevent axial relative movement between two adjacent dumbbell pieces 7. The first telescopic rod 42 and the second telescopic rod 43 can prevent the dumbbell piece 7 from moving radially after extending into the shaft hole 72 of the dumbbell piece 7, thereby effectively locking the dumbbell piece 7 on the first telescopic rod 42 and the second telescopic rod 43 to prevent the dumbbell piece 7 from falling off during training. The safety of dumbbell body is greatly improved. Specifically, When the first telescopic rod 42 and the second telescopic rod 43 exists from a corresponding shaft hole 72, the dumbbell piece 7 with the corresponding shaft hole can be separated from the dumbbell body 1 by radially movement, so as to automatically adjust the weight of the dumbbell. Further, a cross section of the fastening assembly 71 is in a "T" shape.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION

Figure 1:
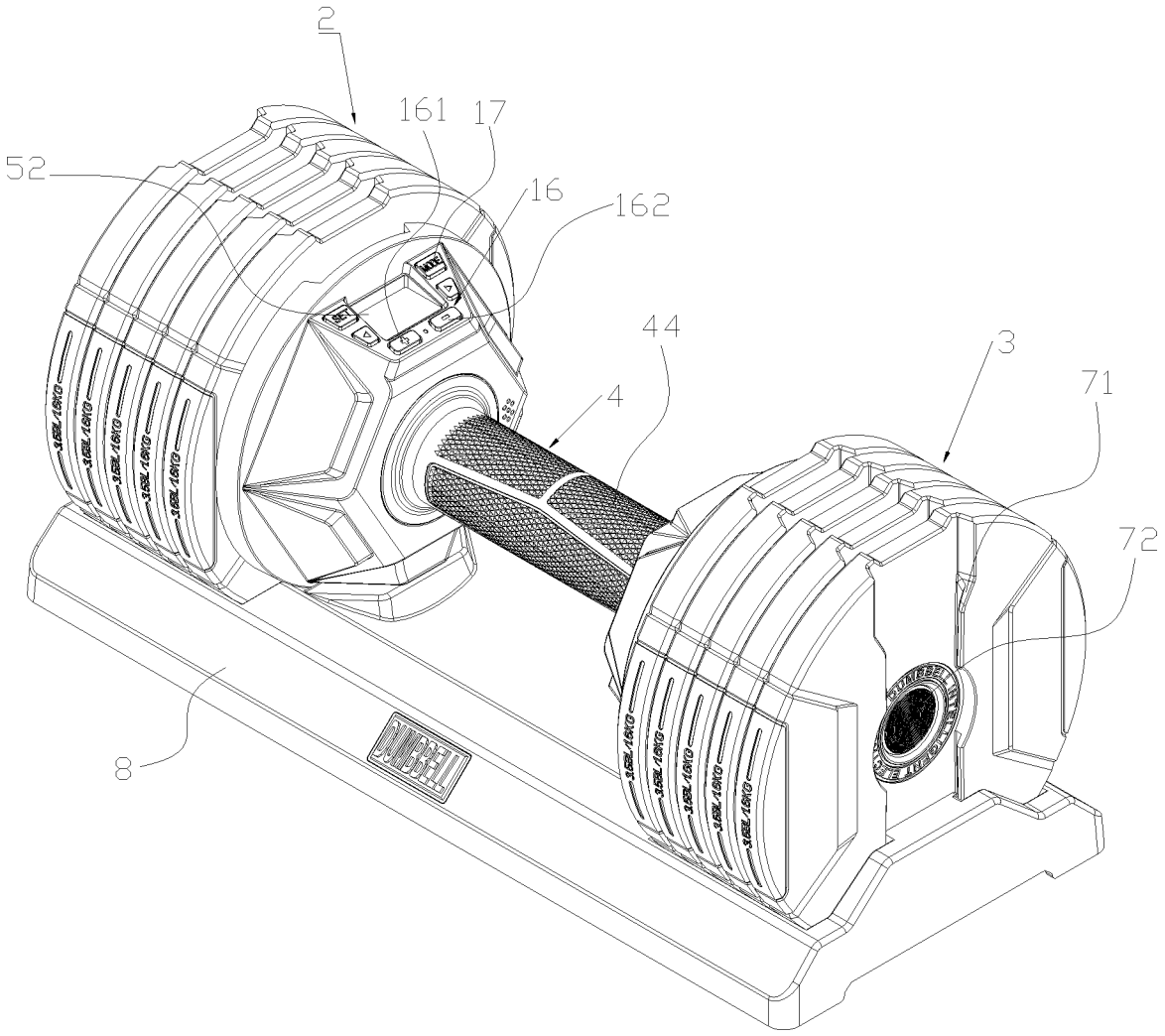
FIG. 1 is a schematic view of an intelligent electrically adjustable dumbbell according to an embodiment of the present disclosure.
Figure 2:
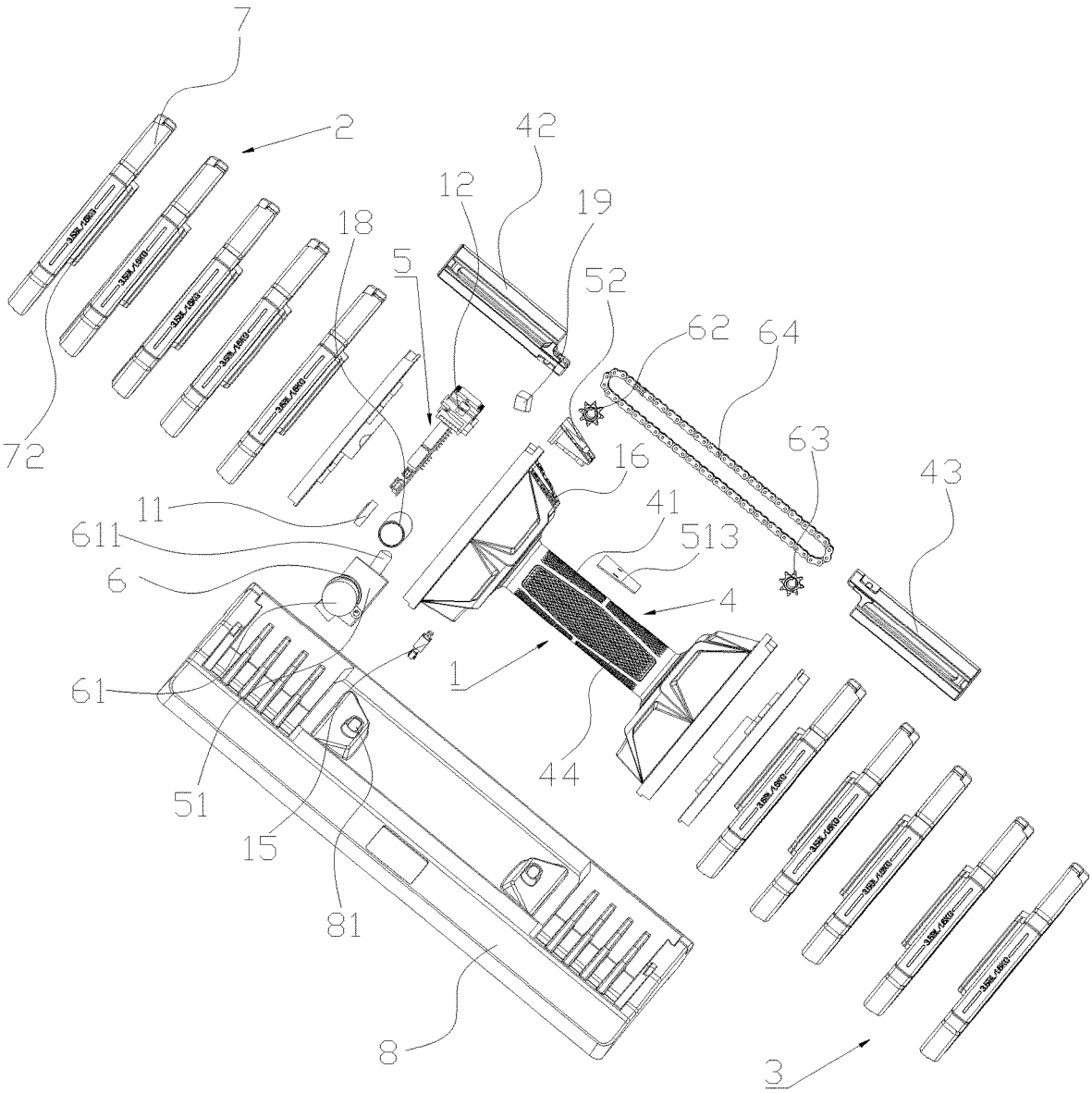
FIG. 2 is an exploded view of the intelligent electrically adjustable dumbbell of FIG. 1, the intelligent electrically adjustable dumbbell including a driving device, a fastening assembly, and a handle.
Figure 3:
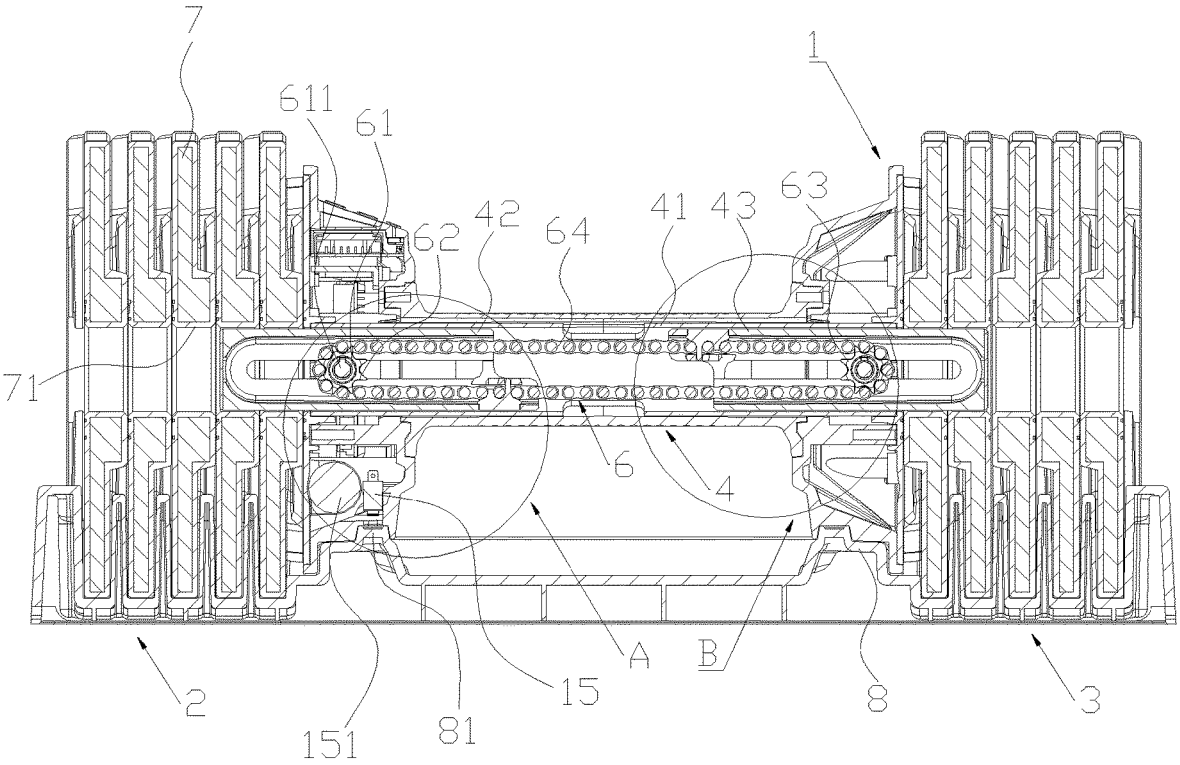
FIG. 3 is a cross-sectional view of the intelligent electrically adjustable dumbbell according to an embodiment of the present disclosure, cutting along the driving device.
Figure 4:
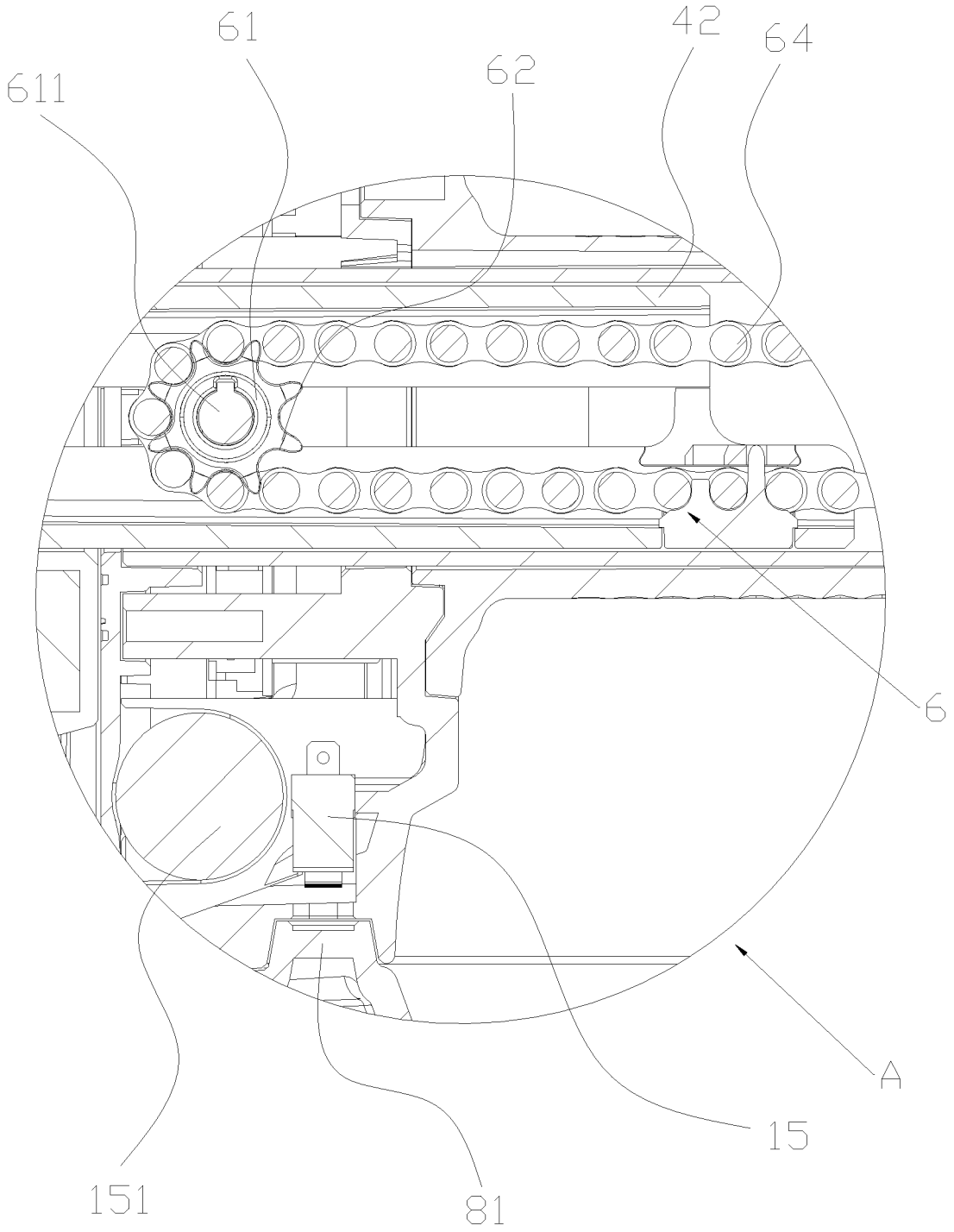
FIG. 4 is an enlarged view of the section A indicated in FIG. 3.
Figure 5:
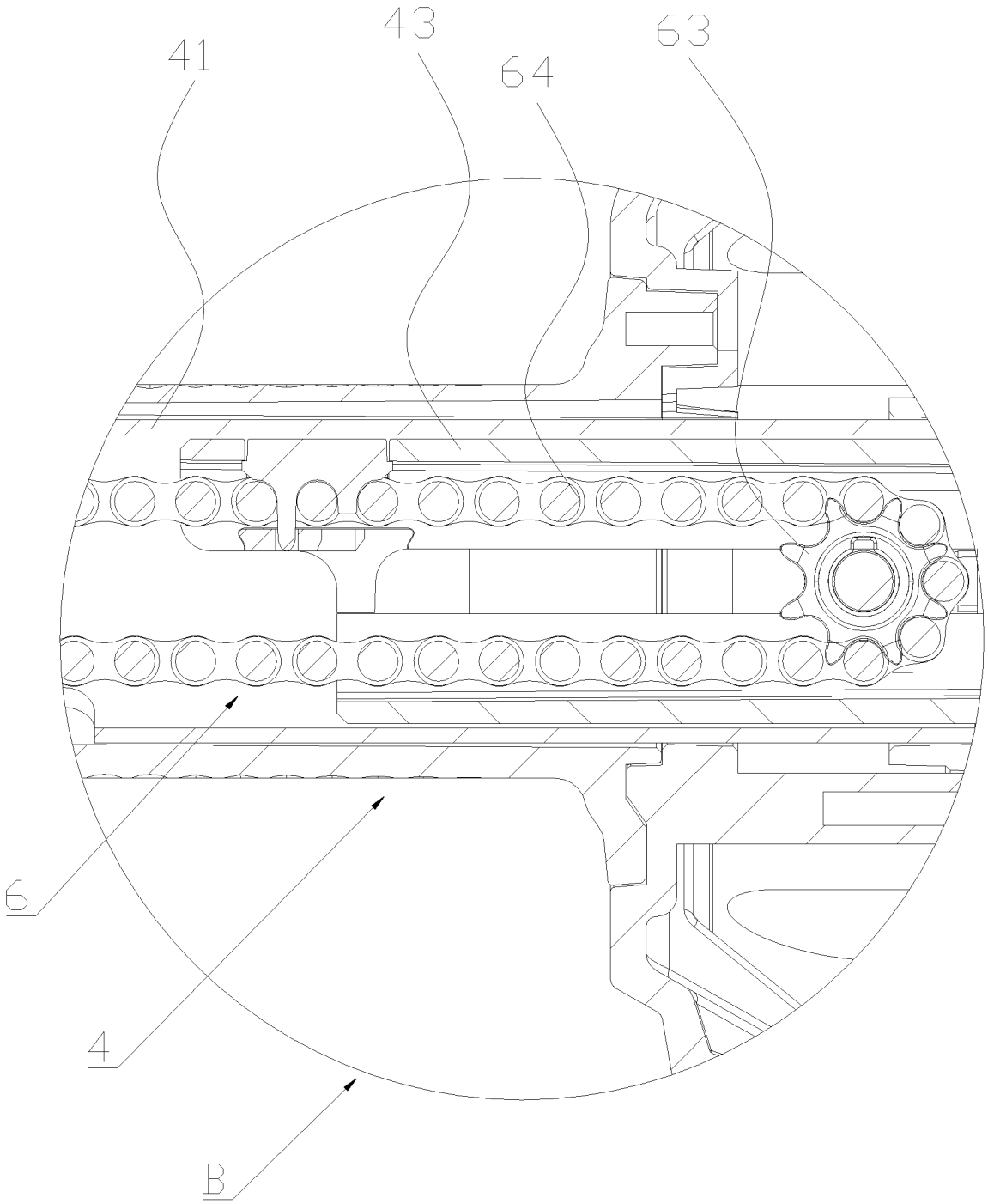
FIG. 5 is an enlarged view of the section B indicated in FIG. 3.
Figure 6:
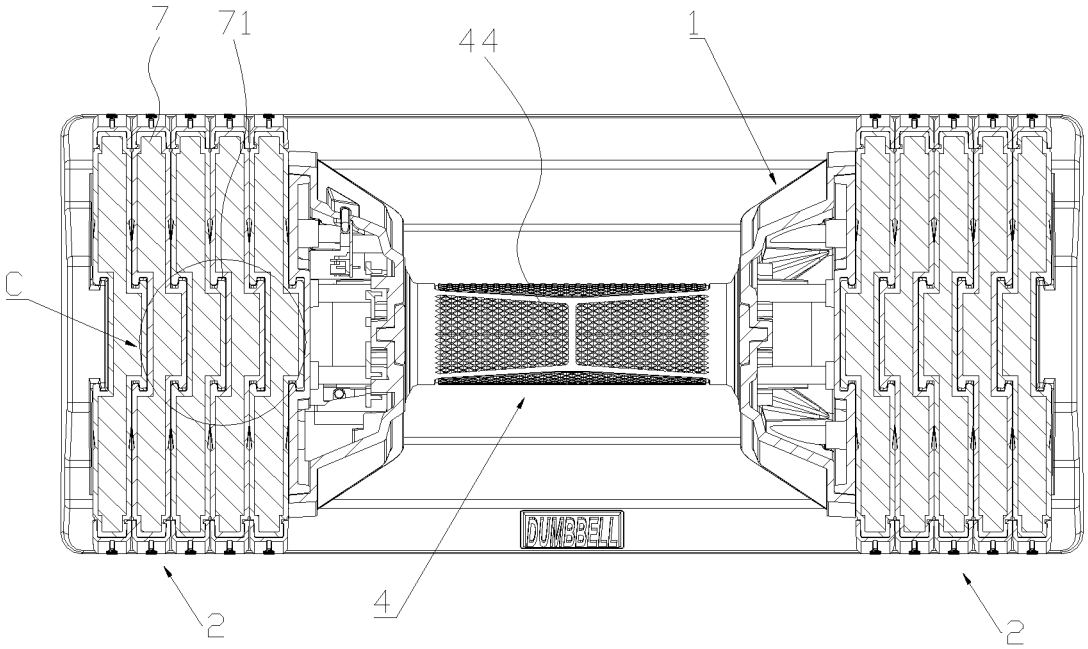
FIG. 6 is a cross-sectional view of the intelligent electrically adjustable dumbbell according to an embodiment of the present disclosure, cutting along the fastening assembly.
Figure 7:
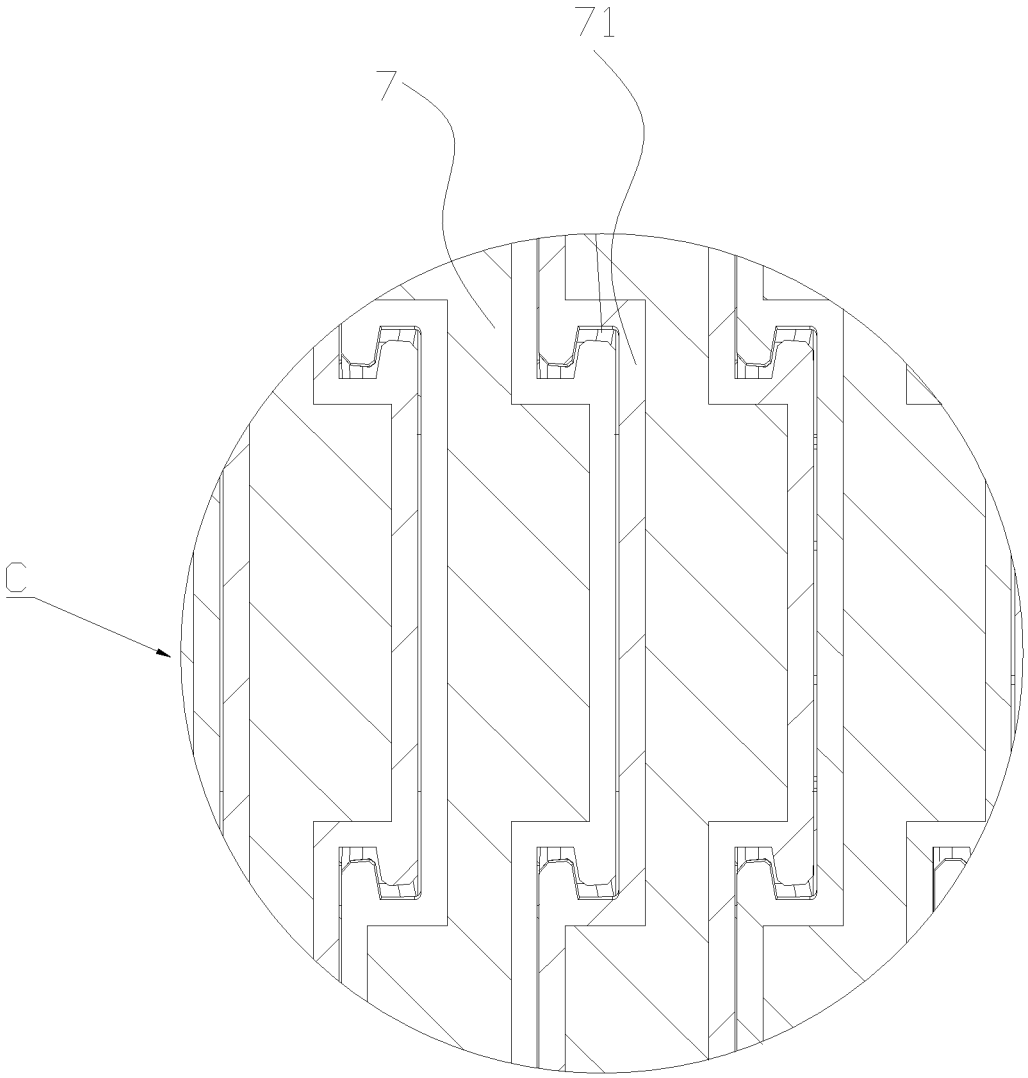
FIG. 7 is an enlarged view of the section C indicated in FIG. 6.
Figure 8:
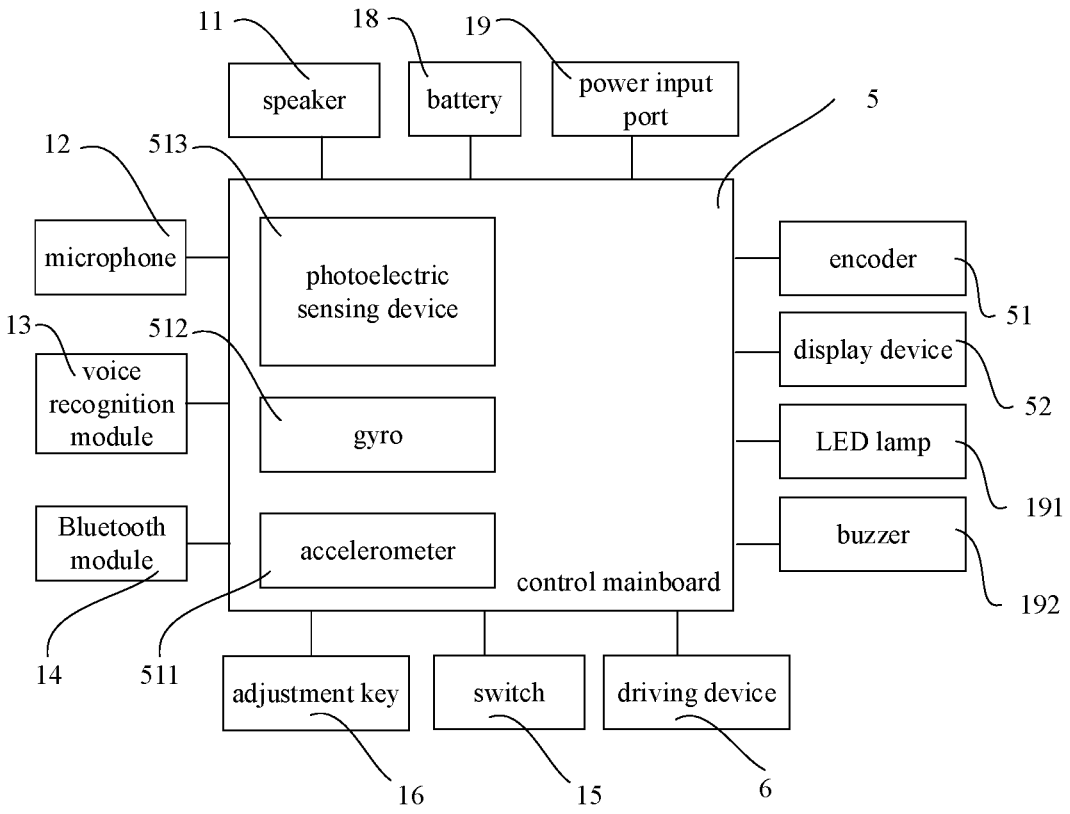
FIG. 8 is an exemplary circuit diagram of an intelligent electrically adjustable dumbbell according to an embodiment of the present disclosure.
Figure 9:
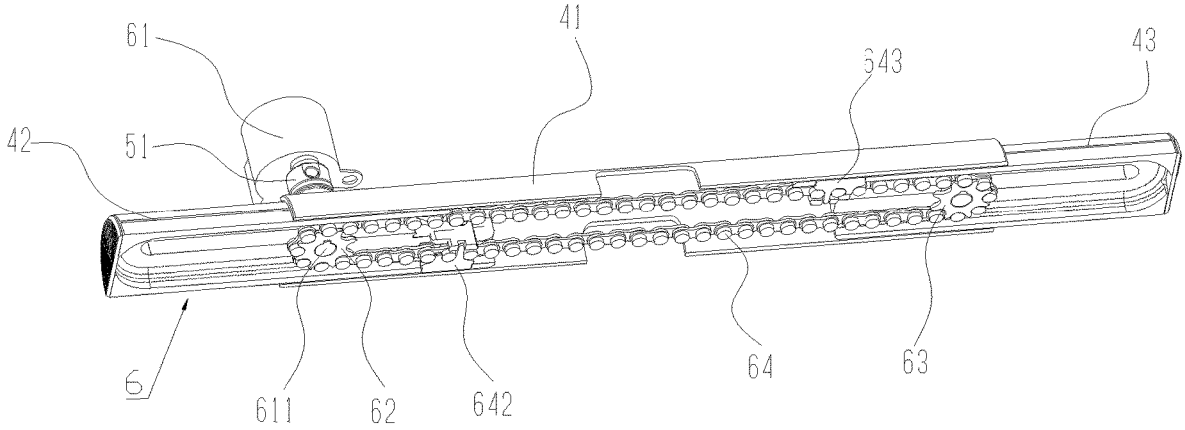
FIG. 9 is a schematic view of a portion of the handle according to a first embodiment of the present disclosure.
Figure 10:
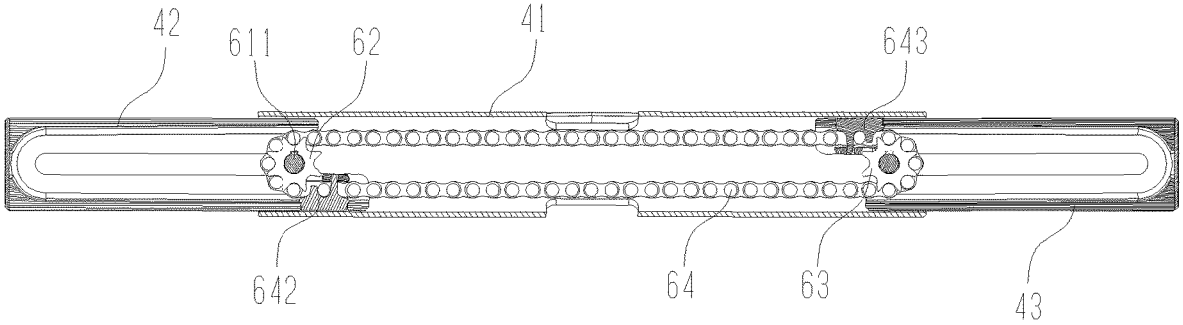
FIG. 10 is a cross-sectional view of the handle in FIG. 9.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the invention, "a plurality of" means two or more, unless otherwise specifically defined.

Referring to FIGS. 1-12, an intelligent electrically adjustable dumbbell includes a dumbbell body 1. The dumbbell body 1 includes a first weight assembly 2, a second weight assembly 3 and a handle 4. The first weight assembly 2 is connected to one end of the handle 4 and the second weight assembly 3 is connected to the other end of the handle 4. The handle 4 includes a handle body 41, a driving device 6 arranged at the handle body 41, a first telescopic rod 42 and a second telescopic rod 43 moveably connected with the handle body 41. The first telescopic rod 42 is connected, with the first weight assembly 2, and the second telescopic rod 43 is connected with the second weight assembly 3. Each of the first weight assembly 2 and the second weight assembly 3 includes a plurality of dumbbell pieces 7. A fastening assembly 71 is arranged between two adjacent dumbbell pieces 7 and configured to prevent the two adjacent dumbbell pieces 7 from moving relative to each other. Each of the dumbbell pieces 7 defines a shaft hole 72. The driving device 6 is configured to drive the first telescopic rod 42 or the second telescopic rod 43 to extend into one or more shaft holes 72 of one or more dumbbell pieces 7 so as to mount the one or more dumbbell pieces 7 onto the handle body 41, thereby adjusting weight of the dumbbell body 1.

Through above-mentioned structures, it effectively realizes a function of automatically adjusting weight of the dumbbell body 1 through the driving device 6, the first telescopic rod 42 and the second telescopic rod 43. Therefore, it does not need users to mount manually the dumbbell pieces to adjust the weight of the dumbbell body, which can save time and manpower, thereby greatly improving user experience. Moreover, since the fastening assembly 71 can prevent axial relative movement between two adjacent dumbbell pieces 7. The first telescopic rod 42 and the second telescopic rod 43 can prevent the dumbbell piece 7 from moving radially after extending into the shaft hole 72 of the dumbbell piece 7, thereby effectively locking the dumbbell piece 7 on the first telescopic rod 42 and the second telescopic rod 43 to prevent the dumbbell piece 7 from falling off during training. The safety of dumbbell body is greatly improved. Specifically, When the first telescopic rod 42 and the second telescopic rod 43 exists from a corresponding shaft hole 72, the dumbbell piece 7 with the corresponding shaft hole can be separated from the dumbbell body 1 by radially movement, so as to automatically adjust the weight of the dumbbell. Further, a cross section of the fastening assembly 71 is in a "T" shape.

In at least one embodiment, the dumbbell body 1 is provided with a switch 15 electrically connected to the driving device 6 and configured to switch on/off the driving device 6. When the switch 15 is activated, the driving device 6 is switched into a working state, and when the switch 15 is not activated, the driving device 6 is switched into a stop state. The dumbbell further includes a tray 8. The tray 8 is provided with a trigger member 81. When the dumbbell body 1 is connected with the tray 8, the trigger member 81 triggers the switch 15, and when the dumbbell body 1 is separated from the tray 8, the trigger member 81 releases trigger of the switch 15. Through such structures, only when the dumbbell body 1 is located on the tray 8 and connected with the tray 8, the weight of the dumbbell body 1 can be adjusted. Therefore, it can effectively prevent the dumbbell from automatic adjusting weight due to error trigger during training. That is, it can effectively prevent the dumbbell pieces 7 from falling off from the first telescopic rod 421 the second telescopic rod 43 to hurt users, which greatly improve safety of the dumbbell. In at least one embodiment, the trigger member 81 is a bump, the switch 15 is provided with an elastic piece 151. When the bump compresses the elastic piece 151, the switch 15 is activated, and when the bump releases the elastic piece 151, the elastic piece 151 restores and the trigger member 81 releases trigger of the switch 15.

Figure 11:
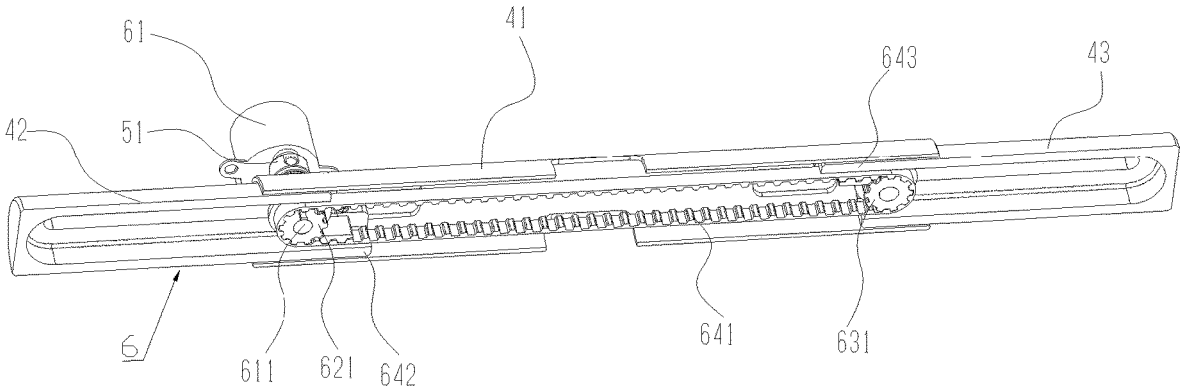
FIG. 11 is a schematic view of a portion of the handle according to a second embodiment of the present disclosure.
Figure 12:
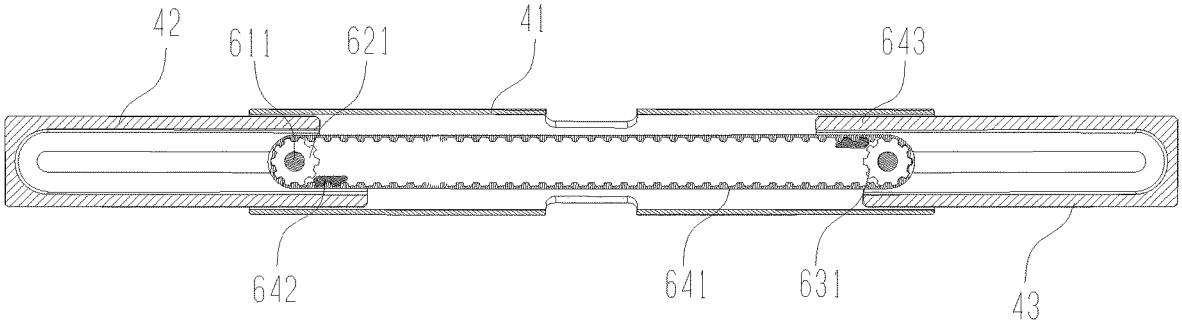
FIG. 12 is a cross-sectional view of the handle in FIG. 11.

In at least one embodiment, the driving device 6 includes a motor 61, a first sprocket 62, a second sprocket 63, and a chain 64. An output axis 611 of the motor 61 is connected with the first sprocket 62, each of the first sprocket 62 and the second sprocket 63 is meshed with the chain 64, so that the output axis 611 of the motor 61 can drive the first sprocket 62, the second sprocket 63 and the chain 64 to rotate. A lower side of the chain 64 is connected to the first telescopic rod 42, and an upper side of the chain 64 is connected to the second telescopic rod 43, so that rotating of the chain 64 can bring the first telescopic rod 42 and the second telescopic rod 43 to extend into shaft holes 72 of one or more dumbbell piece 7. In at least one embodiment, the lower side of the chain 64 is connected to the first telescopic rod 42 through a first connecting member 642, and the upper side of the chain 64 is connected to the second telescopic rod 43 through a second connecting member 643. Through above-mentioned structures, it, is reasonable in design, simple in structure and stable in connection. The function of automatically adjusting the weight of the dumbbell body is effectively realized, which is easy to implement and low in cost. In the embodiment, the chain 64, the first sprocket 62 and the second sprocket 63 are used as transmission mechanism. It should be understood, according to principle similar to the above-mentioned structure, as shown in FIGS. 11 to 12, a synchronous belt 641, a first synchronous wheel 621 and a second synchronous wheel 631 can also be used to replace the chain 64, the first sprocket 62 and the second sprocket 63. In the embodiment shown in FIGS. 11 and 12, the driving device 6 includes a motor 61, a first synchronous wheel 621, a second synchronous wheel 631 and a synchronous belt 641, an output axis 611 of the motor 61 is connected to the first synchronous wheel 621, the first synchronous wheel 621 and the second synchronous wheel 631 are connected with the synchronous belt 641 the output axis 611 is configured to drive the first synchronous wheel 621, the second synchronous wheel 631 and the synchronous belt 641 to rotate, a lower side of the synchronous belt 641 is connected to the first telescopic rod 42, and an upper side of the synchronous belt 641 is connected to the second telescopic rod 43, so that rotation of the synchronous belt 641 is capable of bringing the first telescopic rod 42 and the second telescopic rod 43 to extend into one or more shaft holes 72 of one or more dumbbell pieces 7.

In at least one embodiment, the dumbbell body 1 further includes a control mainboard 5 and a display device 52. The motor 61 includes an encoder 51. The encoder 51 is configured to detect a rotating direction and a rotating angle of the output axis 611 so as to determine the number of the dumbbell pieces 7 whose shaft holes 72 are passed through by the first telescopic rod 42 and the second telescopic rod 43. The control mainboard 5 and the display device 52 are electrically connected with the encoder 51. The control mainboard 5 is configured to determine the weight of the dumbbell body 1 based on the number of the dumbbell pieces 7 whose shaft, holes 72 are passed through by the first telescopic rod 42 and the second telescopic rod 43 and to transmit the weight of the dumbbell body 1 to the display device 52. The display device 52 is configured to display the weight of the dumbbell body 1. Through above-mentioned structure, the number of the number of the dumbbell pieces on the first telescopic rod and the second telescopic rod can be determined according to the rotating direction and the rotating angle of the output axis 611, the weight of the dumbbell body can be determined based on the number of the dumbbell pieces on the first telescopic rod and the second telescopic rod, and the weight of the dumbbell body can be displayed via the display device. It allows users to adjust the weight of the dumbbell body quickly and accurately without complicated calculating, thus effectively improve user experience. In at least one embodiment, the display device can be a display screen.

In at least one embodiment, the control mainboard 5 is further provided with gyros 512 and accelerometers 511. The gyros 512 and the accelerometers 511 are electrically connected with the display device 52. The gyros 512 and, the accelerometers 511 are configured to detect movement times and movement frequency of the dumbbell body 1, and send the movement times and movement frequency of the dumbbell body 1 to the display device 52 so that the display device 52 can display the movement times and movement frequency of the dumbbell body 1. Through above structures, the display device can display the number of times the user lifts the dumbbell body and the frequency of lifting the dumbbell. The user can directly see the number and frequency of lifting the dumbbell through the display device. For example, the motion direction and acceleration of the dumbbell body can, be sensed through the gyros and accelerometers. When the dumbbell body moves upward and then downward, the movement direction changes once, and the movement times are recorded as once and displayed on the display device. The frequency of the user lifting the dumbbell can, be obtained through the acceleration and movement times, and the calorie value consumed by the user in the process of lifting the dumbbell can also be calculated through the movement times and movement frequency. Specifically, the counting method, can be positive counting or countdown, so that users can train more purposefully. It not only does not need users to count themselves, but also makes the training more interesting.

In at least one embodiment, the control mainboard 5 is further provided with a photoelectric sensing device 513, which is electrically connected with the display device 52. The photoelectric sensing device 513 is configured to detect the user's heart rate value and send the user's heart rate value to the display device 52 so that the display device 52 can display the user's heart rate value. Through the above structure, the user can straightly see the user's heart rate value from the display device, so that the user can adjust the frequency of lifting dumbbell body and his own breathing, rhythm according to the heart rate value, so as to make the training more scientific and improve efficiency of training.

In at least one embodiment, the dumbbell body 1 is also provided with a speaker 11, a microphone 12, a voice recognition module 13 and a Bluetooth, module 14. The speaker 1, the microphone 12, the voice recognition module 13 and the Bluetooth module 14 are electrically connected with the control mainboard 5. The microphone 12 is configured to detect user's voice and the voice recognition module 13 is configured to convert the user's voice to commands to adjust the weight of the dumbbell body. The Bluetooth module 14 is configured to be connected to a mobile terminal device so as to receive commands from the mobile terminal device to adjust the weight of the dumbbell body. The speaker 11 is configured to output the commands and/or the weight of the dumbbell body. Through the above structures, the user can control the dumbbell body through the microphone and voice recognition module to adjust the weight of the dumbbell body. Moreover, the dumbbell body can also be connected with, mobile terminal device such as a mobile phone through the Bluetooth module, so that the user can easily adjust the weight of dumbbell body, set training mode, view calories consumed, heart rate and other relevant training data through the mobile terminal device such as the mobile phone. Among them, users can also help trainers formulate training plans, match training tutorials, record training times each time, and remind trainers to complete training tasks as planned through the mobile terminal device such as the mobile phone or the voice recognition module according to gender, age and weight. Specifically, the user can also control the speaker to play music through the mobile terminal device such as the mobile phone or the voice recognition module, so that the user can train with the rhythm of music, which greatly improves fun of training.

In at least one embodiment, the dumbbell body 1 is further provided with an adjustment key 16, which is configured to control the driving device 6 to drive the first telescopic rod 42 and the second telescopic rod 43 into the shaft hole 72 of one or more dumbbell pieces 7. Wherein, the adjustment key 16 includes a first adjusting key unit 161 and a second adjusting key unit 162, and the user can control the first telescopic rod and the second telescopic rod to enter more shaft holes of the dumbbell pieces through clicking the first adjusting key unit 161, so as to increase the weight of the dumbbell main body, and the user can control the first telescopic rod and the second telescopic rod to retract by clicking the second adjusting key unit 162 so as to reduce the weight of the dumbbell body. The dumbbell body 1 is also provided with a switching key 17 for switching training modes. The user can click the switching key 17 to select different training modes, such as positive timing, countdown, positive counting and countdown.

In at least one embodiment, the dumbbell further includes a battery 18 and a power input port 19. The driving, device 6, the control mainboard 5, detection devices (such as the gyros 512, the accelerometers 511, and the photoelectric sensing device 513), the display device 52, the speaker 11, the microphone 12, the voice recognition module 13, the Bluetooth module 14 and the power input port 19 are electrically connected with the battery 18. Through above structures, the battery 18 can supply power to the driving device 6, the control mainboard 5, the detection devices, the display device 52, the speaker 11, the microphone 12, the voice recognition module 13, the Bluetooth module 14, and the display device 52 can display the power of the battery 18.

In at least one embodiment, the handle 4 is provided with anti-skid lines 44. Through above structure, it is easy for users to grasp the handle 4 and lift the dumbbell body, thereby preventing the user's hand from falling off the handle 4. It further improves the safety of the intelligent electrically adjustable dumbbell.

In at least one embodiment, the dumbbell body 1 is further provided with an LED lamp 191 and a buzzer 192. The LED lamp 191 and buzzer 192 are electrically connected with the control mainboard 5 and configured to reminder users of the dumbbell under different working states to effectively improve user experience. For example, when the dumbbell body 1 is separated from the tray 8 and the trigger device 81 releases the trigger of the switch 15, or the driving device 6 is stopped, the LED lamp 191 is switched on and the buzzer 192 outputs sound to remind the user that the weight of the dumbbell body is not adjustable.

The above, description only describes embodiments of the present disclosure, and is not intended to limit the present disclosure, various modifications and changes can be made to the present disclosure. Any modifications, equivalent substitutions, improvements etc. made within the spirit and scope of the present disclosure are intended to be included within the scope of the present disclosure.

What is claimed is:

1. An intelligent electrically adjustable dumbbell comprising a dumbbell body, wherein the dumbbell body comprises:

a handle;

a first weight assembly, connected with one end of the handle;

a second weight assembly, connected with the other end of the handle; and a tray configured to carry the dumbbell body thereon, wherein the tray is provided with a trigger member;

wherein the handle comprises a handle body, a driving device arranged at the handle body, a first telescopic rod and a second telescopic rod movably connected with two opposite ends of the handle body, wherein the first telescopic rod is connected to the first weight assembly and the second telescopic rod is connected to the second weight assembly, wherein each of the first weight assembly and the second weight assembly comprises a plurality of dumbbell pieces, wherein each of the plurality of dumbbell pieces defines a shaft hole, wherein a fastening assembly is connected between two adjacent dumbbell pieces and is configured to prevent the two adjacent dumbbell pieces from relative axial movement, and wherein the driving device is configured to drive the first telescopic rod and the second telescopic rod to extend into one or more shaft holes so as to mount one or more dumbbell pieces onto two opposite ends of the handle body to adjust weight of the dumbbell body;

wherein: the dumbbell body is provided with a switch electrically connected with the driving device, the switch is configured to switch on/off the driving device, when the switch is activated, the driving device is switched to a working state; and when the switch is not activated, the driving device is switched to a stop state;

wherein when the dumbbell body is positioned on the tray, the trigger member activates the switch, and wherein when the dumbbell body is separated from the tray, the trigger member releases trigger of the switch; and wherein: the trigger member is a bump, the switch is provided with an elastic piece, when the bump compresses the elastic piece, the switch is activated, and when the bump releases the elastic piece, the elastic piece restores and the trigger member releases trigger of the switch.

2. The intelligent electrically adjustable dumbbell according to claim 1, wherein the dumbbell body is further provided with an adjustment key configured to control the driving device to drive the first telescopic rod and the second telescopic rod into one or more shaft holes of one or more dumbbell pieces.

3. The intelligent electrically adjustable dumbbell according to claim 2, wherein: the adjustment key comprises a first adjusting key unit and a second adjusting key unit, the first adjusting key unit is configured to control the first telescopic rod and the second telescopic rod to enter more shaft holes of the dumbbell pieces so as to increase the weight of the dumbbell main body, and the second adjusting key unit is configured to control the first telescopic rod and the second telescopic rod to retract so as to reduce the weight of the dumbbell body.

4. The intelligent electrically adjustable dumbbell according to claim 1, wherein the handle is provided with anti-skid lines configured to prevent a user's hand from falling off the handle.

5. The intelligent electrically adjustable dumbbell according to claim 1, wherein a cross section of the fastening assembly is in a T shape.

6. An intelligent electrically adjustable dumbbell comprising a dumbbell body, wherein the dumbbell body comprises:

a handle;

a first weight assembly, connected with one end of the handle; and a second weight assembly, connected with the other end of the handle;

wherein the handle comprises a handle body, a driving device arranged at the handle body, a first telescopic rod and a second telescopic rod movably connected with two opposite ends of the handle body, wherein the first telescopic rod is connected to the first weight assembly and the second telescopic rod is connected to the second weight assembly, wherein each of the first weight assembly and the second weight assembly comprises a plurality of dumbbell pieces, wherein each of the plurality of dumbbell pieces defines a shaft hole, wherein a fastening assembly is connected between two adjacent dumbbell pieces and is configured to prevent the two adjacent dumbbell pieces from relative axial movement, and wherein the driving device is configured to drive the first telescopic rod and the second telescopic rod to extend into one or more shaft holes so as to mount one or more dumbbell pieces onto two opposite ends of the handle body to adjust weight of the dumbbell body;

wherein the driving device comprises a motor, a first sprocket, a second sprocket and a chain, wherein: an output axis of the motor is connected to the first sprocket, the first sprocket and the second sprocket are meshed with the chain, the output axis is configured to drive the first sprocket, the second sprocket and the chain to rotate, a lower side of the chain is connected to the first telescopic rod, and an upper side of the chain is connected to the second telescopic rod, so that rotation of the chain is capable of bringing the first telescopic rod and the second telescopic rod to extend into one or more shaft holes of one or more dumbbell pieces.

7. The intelligent electrically adjustable dumbbell according to claim 6, wherein: the dumbbell body is further provided with a control mainboard and a display device, the motor is provided with an encoder, the encoder is configured to detect a rotation direction and a rotation angle so as to determine the number of the dumbbell pieces whose shaft holes are passed through by the first telescopic rod and the second telescopic rod, the control mainboard and the display device are electrically connected to the encoder, the control mainboard is configured to determine the weight of the dumbbell body according to the number of the dumbbell pieces whose shaft holes are passed through by the first telescopic rod and the second telescopic rod and to transmit the weight of the dumbbell body to the display device, and the display device is configured to display the weight of the dumbbell body.

8. The intelligent electrically adjustable dumbbell according to claim 7, wherein the control mainboard is further provided with a gyro and an accelerometer, wherein the gyro and the accelerometer are electrically connected to the display device and configured to detect movement times and frequencies of the dumbbell body and transmit the movement times and frequencies of the dumbbell body to the display device so that the display device is capable of displaying the movement times and frequencies of the dumbbell body.

9. The intelligent electrically adjustable dumbbell according to claim 7, wherein the control mainboard is further provided with a photoelectric sensing device electrically connected with the display device, and wherein the photoelectric sensing device is configured to detect a user's heart rate and transmit the heart rate to the display device for displaying the user's heart rate.

10. The intelligent electrically adjustable dumbbell according to claim 7, wherein the dumbbell body is further provided with a microphone and a voice recognition module electrically connected with the control mainboard, and wherein the microphone is configured to detect a user's voice and the voice recognition module is configured to convert the user's voice into commands to adjust the weight of the dumbbell body.

11. The intelligent electrically adjustable dumbbell according to claim 7, wherein the dumbbell body is further provided with a Bluetooth module electrically connected to the control mainboard and is configured to be connected to a mobile terminal device so as to receive commands from the mobile terminal device to adjust the weight of the dumbbell body.

12. The intelligent electrically adjustable dumbbell according to claim 11, wherein the dumbbell body is further provided with a speaker electrically connected with the control mainboard and configured to output the weight of the dumbbell body.

13. The intelligent electrically adjustable dumbbell according to claim 7, wherein the dumbbell is further provided with a battery and a power input port configured to supply power to the driving device, the control mainboard and the display device.

14. The intelligent electrically adjustable dumbbell according to claim 7, wherein the dumbbell body is further provided with an LED lamp and a buzzer, and wherein the LED lamp and the buzzer are electrically connected with the control mainboard.

15. An intelligent electrically adjustable dumbbell comprising a dumbbell body, wherein the dumbbell body comprises:

a handle;

a first weight assembly, connected with one end of the handle; and a second weight assembly, connected with the other end of the handle;

wherein the handle comprises a handle body, a driving device arranged at the handle body, a first telescopic rod and a second telescopic rod movably connected with two opposite ends of the handle body, wherein the first telescopic rod is connected to the first weight assembly and the second telescopic rod is connected to the second weight assembly, wherein each of the first weight assembly and the second weight assembly comprises a plurality of dumbbell pieces, wherein each of the plurality of dumbbell pieces defines a shaft hole, wherein a fastening assembly is connected between two adjacent dumbbell pieces and is configured to prevent the two adjacent dumbbell pieces from relative axial movement, and wherein the driving device is configured to drive the first telescopic rod and the second telescopic rod to extend into one or more shaft holes so as to mount one or more dumbbell pieces onto two opposite ends of the handle body to adjust weight of the dumbbell body;

wherein the driving device comprises a motor, a first synchronous wheel, a second synchronous wheel and a synchronous belt, wherein: an output axis of the motor is connected to the first synchronous wheel, the first synchronous wheel and the second synchronous wheel are connected with the synchronous belt, the output axis is configured to drive the first synchronous wheel, the second synchronous wheel and the synchronous belt to rotate, a lower side of the synchronous belt is connected to the first telescopic rod, and an upper side of the synchronous belt is connected to the second telescopic rod, so that rotation of the synchronous belt is capable of bringing the first telescopic rod and the second telescopic rod to extend into one or more shaft holes of one or more dumbbell pieces.

* * * * *